US005699815A

United States Patent [19]

Furukawa

[11] Patent Number: 5,699,815

[45] Date of Patent: Dec. 23, 1997

[54] HAIR CLIP

[75] Inventor: Toshiyuki Furukawa, Osaka, Japan

[73] Assignee: Lucky Corporation Co., Ltd., Osaka, Japan

[21] Appl. No.: 633,178

[22] Filed: Apr. 16, 1996

[51] Int. Cl.[6] ..... A45D 8/28

[52] U.S. Cl. ..... 132/279; 132/275; 132/276; 132/277; 132/278

[58] Field of Search ..... 132/273, 276, 132/277, 278, 279, 275; 24/455, 506, 457, 459

[56] References Cited

U.S. PATENT DOCUMENTS

| | | | |
|---|---|---|---|
| 1,354,236 | 9/1920 | Bour | 132/279 |
| 4,976,277 | 12/1990 | Yasuda | 132/279 |
| 5,109,878 | 5/1992 | Kuo-hua | 132/279 |
| 5,259,405 | 11/1993 | Hua-Chou | 132/279 |

*Primary Examiner*—Gene Mancene
*Assistant Examiner*—Pedro Philogene
*Attorney, Agent, or Firm*—Koda and Androlia

[57] ABSTRACT

A fastener part 6 on one end of a base plate 1 includes clip arms 7 having enough length to deform flexibly to release a clip plate 2 from the base plate 1, and extending from the base plate 1 toward an axis part 3 on the other end of the base plate 1, so that the height of the fastener part 6 from the base plate 1 is low to form a thin and attractive hair clip, which fits comfortably. When the base plate 1 and the clip plate 2 engage each other, the clip plate 2, curving to bulge out toward the base plate 1, presses the base plate 1 and the base plate 1 is formed into a bow shape along the clip plate 2 by its flexibility, so that the plates 1 and 2 contact each other broadly and press strongly against each other to hold hair securely between them.

6 Claims, 5 Drawing Sheets

HAIR CLIP

BACKGROUND OF THE INVENTION AND DESCRIPTION OF THE PRIOR ART

The present invention relates to a hair clip, or a barrette, which easily holds hair and is easily removed therefrom.

As shown in FIG. 6, a conventional hair clip includes a base plate 1 and a clip plate 2, wherein one end of the clip plate 2 is connected pivotally to axis arms 4 extending linearly in a perpendicular direction from one end of the base plate 1 and facing each other, and the other end of the clip plate 2 removably snaps into an fastener part 6 provided on the other end of the base plate 1 to obtain the engagement. The fastener part 6 has clip arms 7 extending linearly in a perpendicular direction from the base plate 1 and facing each other. By pinching both clip arms 7, the engagement between the base plate 1 and the clip plate 2 is released. The clip plate 2 is curved to bulge out toward the base plate 1 so that hair is clipped between the base plate 1 and the clip plate 2. When stoppers 10, as shown in FIG. 7 formed on the axis end of the clip plate 2 contact with stepped pieces 16, as shown in FIG. 6, formed on the axis arms 4, the clip plate 2 moves away from the base plate 1.

With this kind of hair clip, as both ends of the clip plate 2 are respectively attached to the tips of the axis arms 4 and the clip arms 7 extending linearly in a perpendicular direction from the base plate 1, the both ends of the clip plate 2 are raised from the base plate 1 due to the length of the axis arm 7 and the clip arm 7. Additionally, the pressure of the clip plate 2 on the base plate 1 is restrained since the stoppers 10 of the clip plate 2 contact with the stepped pieces 16 of the axis arms 4. Therefore, such a hair clip needs to have a clip plate composed of a very flexible material so as to hold hair between a base plate and a clip plate. However, a very flexible clip plate may hold hair too tightly and thus damage hair.

To improve such a hair clip, Japanese Utility Model Application No. 63-33846 discloses a hair clip as shown in FIG. 8, which includes a protuberance 14 formed on the center part of a clip plate 2. In this structure, as the resilient force of the protuberance 14 acts to reinforce the flexibility of the clip plate 2, the clip plate 2 may be composed of less flexible material than that of the conventional hair clip to hold hair.

How ever, with the above described hair clips having the stepped pieces 16 formed on the axis arms, since the stoppers 10 formed on one end of the clip plate 2 contact with the stepped pieces 16, the other end of the clip plate 2 moves away from the fastener end of the base plate 1 when the engagement between the base plate 1 and the clip plate 2 is released. Therefore, the pressure of the clip plate 2 against the base plate 1 is restrained and is not utilized effectively to hold hair since the clip plate 2 is forced to move away from the base plate 1 by the stepped pieces 16.

Furthermore, a certain length of the clip arms 7 is needed for gripping easily, and also for deforming flexibly to release the engagement between the base plate 1 and the clip plate 2. Such a conventional hair clip includes the clip arm 7 having enough length to grip and extending linearly in a perpendicular direction from the base plate 1.

Therefore, the design of a hair clip, as a whole, becomes bulky, resulting in an unattractive appearance and an uncomfortable fit.

OBJECT AND SUMMARY OF THE INVENTION

It is hence an object of the present invention to provide a thin and attractive hair clip, which fits comfortably.

It is another object of the present invention to provide a hair clip, wherein the pressure of a clip plate on a base plate is used effectively to hold hair securely between the base plate and the clip plate.

A hair clip of the present invention includes a base plate and a clip plate, which is curved to bulge out toward the base plate so as to press hair against the base plate and hold hair between the plates when they engage each other. One end of the clip plate is connected pivotally to an axis part provided on one end of the base plate, and the other end of the clip plate is snappable into a fastener part provided on the other end of the base plate to obtain the engagement and releasable from the fastener part. The fastener part has clip arms having enough length to deform flexibly to release the engagement between the base plate and the clip plate, and extending from the base plate and curving toward the axis part of the base plate.

Preferably, a hair clip of the present invention includes the clip arms extending in a substantial L-shape from the base plate toward the axis part.

More preferably, a hair clip of the present invention includes a protuberance formed by lifting and curving the separated portion, which is the portion between incisions cut longitudinally in the center part of the clip plate, in an outward direction from the base plate.

Further, a hair clip of the present invention may include the base plate and the clip plate, which contact each other and maintain the power to spring away each other when they engage each other.

DETAILED DESCRIPTION OF THE PREFERRED EMBODIMENTS

Figure 1:
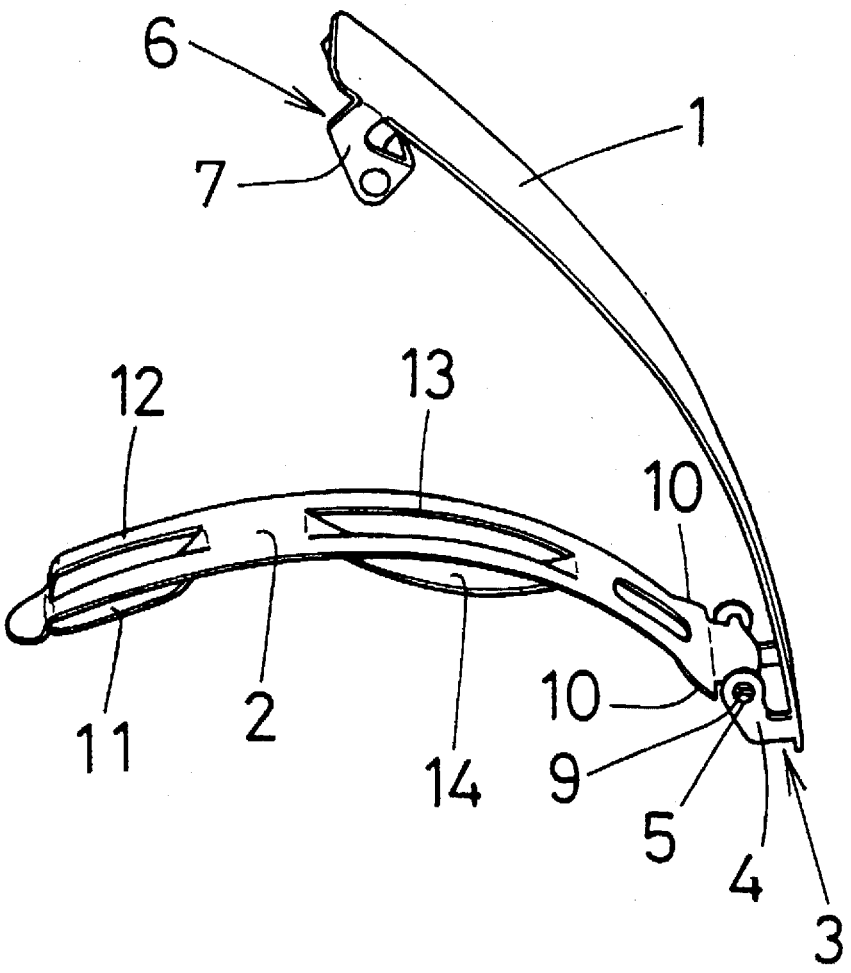
FIG. 1 is a perspective view of a first embodiment of a hair clip of the invention, wherein a clip plate is released from a base plate.

Referring now in detail to the drawings, particularly FIG. 1, a base plate 1, which faces outward hair when a hair clip holds hair, is formed into an oblong plate composed of flexible material, such as flexible metal, and a clip plate 2, which presses the hair on the base plate 1, is formed into an oblong plate composed of flexible material, such as flexible metal, and is curved to bulge out toward the base plate 1.

An axis part 3 facing the clip plate 2, is provided protrusively on one end of the base plate 1. The axis part 3 includes axis arms 4, which axis holes 5 are provided at the tips, facing each other and extending in an L-shape from the base plate 1 toward the other end of the base plate 1.

A fastener part 6 facing the clip plate 2, is provided protrusively on the other end of the base plate 1. The fastener part 6 includes clip arms 7 facing each other and extending in an L-shape from the base plate 1 toward the axis part 3 while having enough length to deform flexibly to release the clip plate 2 from the fastener part 6.

Therefore, since the height of the fastener part 6 is equivalent to the distance from the base plate 1 to the outward corner of the L-shape of the clip arm V and the height of the axis part 3 is equivalent to the distance from the base plate 1 to the outward corner of the L-shape of the axis arm 4, the distance of both ends of the clip plate 2 from the base plate 1 is small while the clip arms 7 have suitable length for gripping.

Although the axis arms 4, and the clip arms 7 extend in an L-shape from the base plate 1 in this embodiment, it is to be understood that an L-shape is not limited to specific embodiments and the arms may extend in any shape from the base plate 1 toward each other.

Figure 2:
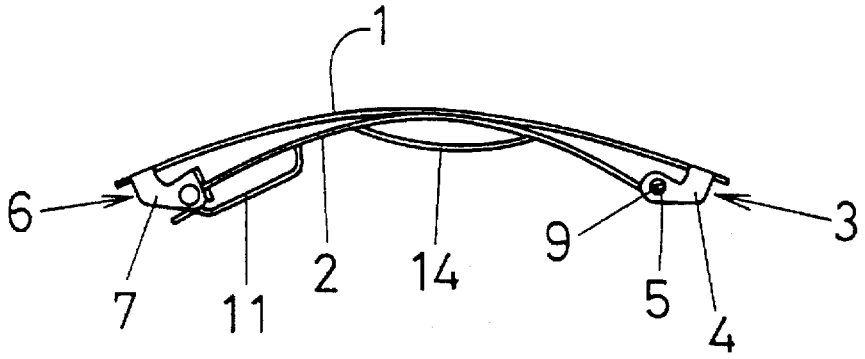
FIG. 2 is a side view of the hair clip in FIG. 1 wherein the base plate and the clip plate engage each other.

As shown in FIG. 2, when the base plate 1 and the clip plate 2 engage each other, the center part of the clip plate 2, which is curved to bulge out toward the base plate 1, presses the base plate 1 and the base plate 1 is formed into a bow shape along the clip plate 2 by its flexibility, so that the base plate 1 and the clip plate 2 contact each other broadly, and maintain the power to spring away each other. Therefore, the base plate 1 and the clip plate 2 press strongly against each other to hold hair securely between them.

Figure 3:
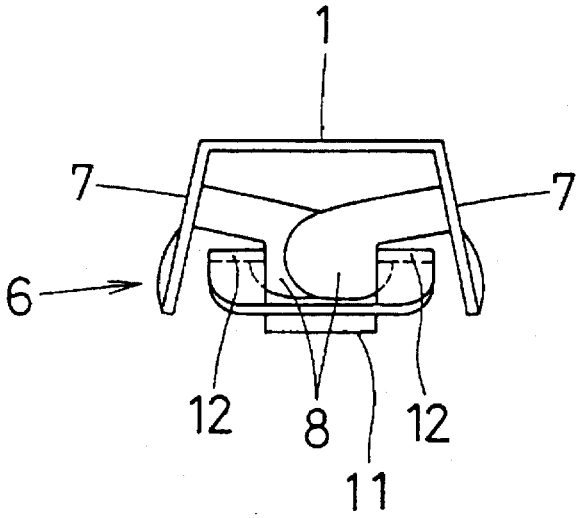
FIG. 3 is a front view of a fastener part of the hair clip in FIG. 2.

As shown in FIG. 3, the fastener part 6 is composed of a pair of right and left clip arms 7 and a pair of right and left catch pieces 8. By pinching both clip arms 7 the clip arms 7 deform flexibly and move inwards so that the catch pieces 8 move inwards to release the clip plate 2.

Figure 4:
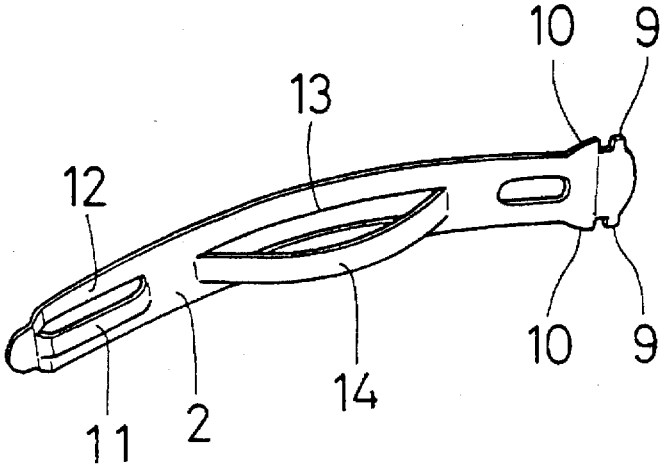
FIG. 4 is a perspective view of the clip plate of the hair clip in FIG. 1.

As shown in FIG. 4, a pair of right and left outward projections 9 and a pair of right and left stoppers 10 are formed on the axis end of the clip plate 2. Each of the projections 9 is inserted rotatably into the corresponding axis hole 5 formed on the axis arms 4, as shown in FIG. 1, so that the clip plate 2 pivots at the projections 9. As in the conventionally known structures, a raised portion 11 and a pair of snaps 12 are formed on the snappable end of the clip plate 2. By pressing the snappable end of the clip plate 2 on the fastener part 6 of the base plate 1, each of the snaps 12 engage with the corresponding catch piece 8 as shown in FIG. 3.

When the catch pieces 8 move inwards by pinching both clip arms 7, the snaps 12 are released from the catch pieces 8 and the clip plate 2 springs pivotally away from the base plate 1.

As shown in FIG. 4, a pair of parallel incisions 13 are provided longitudinally in the center part of the clip plate 2. The separated center part between the parallel incisions 13 is lifted and curved in the outward direction from the base plate 1 to form a protuberance 14. As the resilient force of the protuberance 14 acts to reinforce the flexibility of the clip plate 2, hair is held securely and effectively between the base plate 1 and the clip plate 2.

Figure 5:
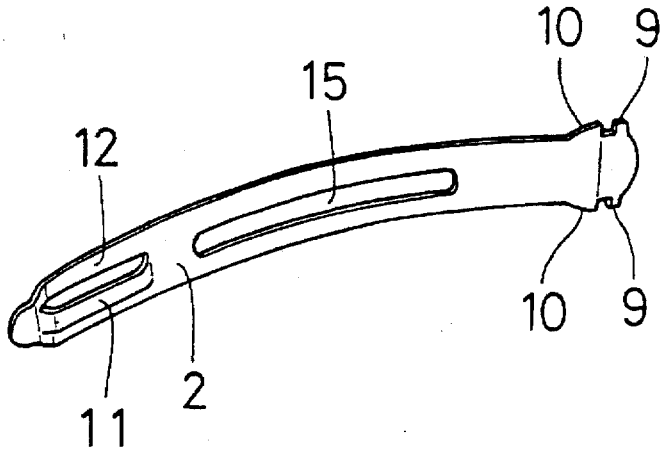
FIG. 5 is a perspective view of a clip plate of another embodiment of a hair clip of the invention.
Figure 6:
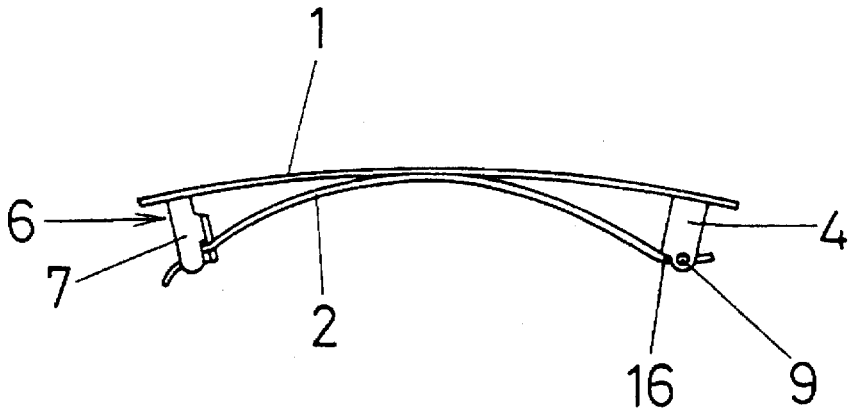
FIG. 6 is a side view of an embodiment of a conventional hair clip.
Figure 7:
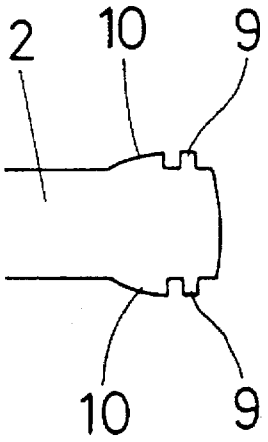
FIG. 7 is a partial plan view of one end of a clip plate of a conventional hair clip.
Figure 8:
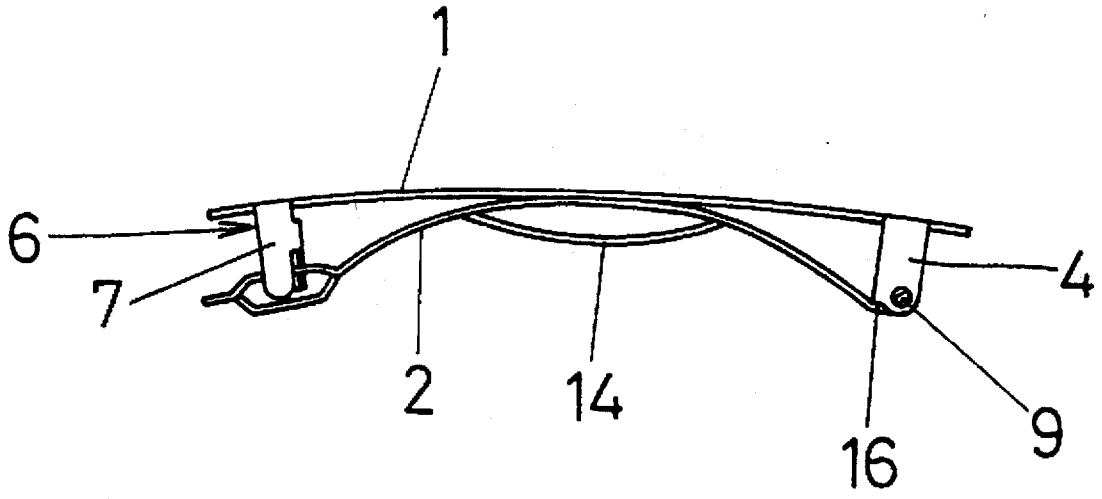
FIG. 8 is a side view of another embodiment of a conventional hair clip.

Another embodiment of a hair clip of the present invention is shown in FIG. 5. Instead of the clip plate 2 of the first embodiment shown in FIG. 4, a clip plate 2 of this embodiment has a cut-out hole 15 formed in the center of the clip plate 2.

By diversifying decorations mounted on the opposite side of the base plate 1 to the clip plate 2, the above described hair clip has various decorative styles.

In the process of using a hair clip of the present invention, the clip plate 2 is released from the base plate 1, hair is placed between the base plate 1 and the clip plate 2, and the snappable end of the clip plate 2 is pressed on the fastener part 6 of the base plate 1 so that the clip plate 2 engages with the fastener part 6 to hold hair securely between the base plate 1 and the clip plate 2.

Only by pinching both clip arms 7 of the fastener part 6, the engagement between the plates 1 and 2 is released and the clip plate 2 springs pivotally away from the base plate 1 by the rebound of its pressure on the base plate 1 so as to release a hair clip easily from hair.

Being constructed as above, the present invention can provide a thin and attractive hair clip, which fits comfortably, wherein a base plate and a clip plate of the hair clip contact each other broadly and press strongly against each other to hold hair securely between them when they engage each other. Further, the base plate and the clip plate easily engage each other and disengage from each other by pinching clip arms of the base plate.

What is claimed is:

1. A hair clip comprising:

a base plate (1);

a clip plate (2) curving to bulge out toward said plate (1) so as to press hair against said base plate (1) and hold hair between said base plate (1) and said clip plate (2) when said base plate (1) and said clip plate (2) engage each other;

an axis part (3) facing said clip plate (2) and being provided on one end of said base plate (1);

a fastner part (6) facing said clip plate (2) and being provided on the other end of said base plate (1), said fastener part (6) comprising clip arms (7), which have enough length to deform flexibly to release the engagement between said base plate (1) and said lip plate (2), and said clip arms (7) extending from said base plate (1) toward said axis part (3); and where one end of said clip plate (2) is connected pivotally to said axis part (3), and the other end of said clip plate (2) is snappable into said fastener part (6) to obtain said engagement and releasable from said fastner part (6).

2. A hair clip according to claim 1, wherein said clip arm (7) extend in an L-shape from said base plate (1) toward said axis part (3).

3. A hair clip according to claim 1, wherein incisions (13) are cut longitudinally in the center part of said clip plate 2, and a portion between said incisions (13) is lifted and curved in an outward direction from said base plate (1) to form a protuberance (14).

4. A hair clip according to claim l, wherein said base plate (1) and said clip plate (2) contact each other so that said base plate (1) and said clip plate (2) maintain a power to spring away each other when said base plate (1) and said clip plate (2) engage each other.

5. A hair clip according to claim 2, herein said base plate (1) and said clip plate (2) contact each other so that said base plate (1) and said clip plate (2) maintain a power to spring away each other when said base plate (1) and said clip plate (2) engage each other.

6. A hair clip according to claim 3, herein said base plate (1) and said clip plate (2) contact each other so that said base plate (1) and said clip plate (2) maintain a power to spring away each other when said base plate (1) and said clip plate (2) engage each other.

* * * * *